US007848669B2

(12) United States Patent
Torimaru

(10) Patent No.: US 7,848,669 B2
(45) Date of Patent: Dec. 7, 2010

(54) IMAGE FORMING APPARATUS

(75) Inventor: Yuusuke Torimaru, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 206 days.

(21) Appl. No.: 12/269,342

(22) Filed: Nov. 12, 2008

(65) Prior Publication Data

US 2009/0290892 A1 Nov. 26, 2009

(30) Foreign Application Priority Data

Nov. 16, 2007 (JP) ..... 2007-298390

(51) Int. Cl.
*G03G 15/00* (2006.01)
*G03G 15/16* (2006.01)

(52) U.S. Cl. ..... 399/45; 399/319

(58) Field of Classification Search ..... 399/397, 399/388, 316, 45, 319
See application file for complete search history.

(56) References Cited

U.S. PATENT DOCUMENTS 3,932,035 A * 1/1976 Sato et al. ..... 399/319
5,493,372 A * 2/1996 Mashtare et al.
6,385,429 B1 * 5/2002 Weber et al. ..... 399/319

FOREIGN PATENT DOCUMENTS

JP 08190282 A * 7/1996
JP 2000344392 A * 12/2000
JP 2005134745 A * 5/2005
JP 2005-338423 12/2005
JP 2007-140413 6/2007

* cited by examiner

*Primary Examiner*—Susan S Lee
(74) *Attorney, Agent, or Firm*—Fitzpatrick, Cella, Harper & Scinto

(57) ABSTRACT

An image forming apparatus includes an image bearing member for bearing a toner image, a transfer member for forming a transfer portion for transferring the toner image onto a recording material in contact with the image bearing member, a vibration imparting portion for imparting vibration at a variable frequency to the recording material having passed through the transfer portion, and a control portion for controlling the frequency by the vibration imparting portion so that the frequency is decreased with an increasing length of the recording material having passed through the transfer portion during a process of passing the recording material through the transfer portion.

6 Claims, 8 Drawing Sheets

(a) SECONDARY TRANSFER PORTION (b) CANTILEVER VIBRATION

IMAGE FORMING APPARATUS

FIELD OF THE INVENTION AND RELATED ART

The present invention relates to an image forming apparatus for separating a recording material, onto which a toner image is transferred, from an image bearing member or a recording material conveyer belt.

An image forming apparatus in which a recording material, onto which a toner image is transferred at a transfer portion formed by bring an image bearing member and a transfer member into contact with each other, is curvature-separated from the image bearing member to be sent into a fixing device has been put into practical use.

Further, an image forming apparatus in which a toner image is transferred from an image bearing member onto a recording material carried on a recording material conveyer belt and thereafter the recording material is curvature-separated at a transfer portion to be sent into a fixing device has also been put into practical use.

In these image forming apparatuses, when image formation is carried out by using a recording material liable to be electrically charged or a recording material which is thin and has low rigidity, it is difficult to curvature-separated the recording material from the image bearing member or the recording material conveyer belt.

For this reason, such a technique using a vibration imparting portion for imparting vibration to the recording material in order to assist the curvature separation (self-stripping) of the recording material at the transfer portion or a separation portion has been proposed.

Japanese Laid-Open Patent Application (JP-A) 2005-338423 discloses an image forming apparatus for transferring a toner image from a photosensitive drum onto a recording material carried on a recording material conveyer belt. In the image forming apparatus, a supporting roller for creating a separating portion by folding the recording material conveyer belt back is formed in a polygonal cross-sectional shape to impart vibration to the recording material conveyer belt, thus facilitating separation of the recording material from the recording material conveyer belt.

JP-A 2007-140413 discloses a full-color image forming apparatus of one-drum intermediary transfer type including a rotary developing device. In the image forming apparatus, an ultrasonic vibration element is disposed downstream of a primary transfer portion and imparts vibration to an intermediary transfer belt, so that a transfer efficiency during transfer of a toner image from the photosensitive drum to the intermediary transfer belt is enhanced.

Here, it has been known that a primary resonance frequency is different when a length of the recording material, having passed through the transfer portion, from a leading end to the transfer portion is different.

For this reason, as described in JP-A 2005-338423, in the case where a frequency of the vibration imparting portion is always constant at a constant conveying speed of the recording material, the vibration imparting portion can provide a frequency capable of enhancing a separation performance on the leading end side of the recording material but cannot provide such a frequency on a rear end side of the recording material.

The vibration impartment to the intermediary transfer belt in JP-A 2007-140413 is also accompanied with a problem similar to that in JP-A 2005-338423 since a frequency of the vibration impartment during passing of the intermediary transfer belt through the transfer portion is kept constant.

Therefore, such a constitution that a frequency capable of enhancing the separation performance can be provided even when the length of the recording material having passed through the transfer portion is increased is desired.

SUMMARY OF THE INVENTION

A principal object of the present invention is to provide an image forming apparatus capable of enhancing a separation performance of a recording material by imparting vibration to the recording material.

According to an aspect of the present invention, there is provided an image forming apparatus comprising:

an image bearing member for bearing a toner image;

a transfer member for forming a transfer portion for transferring the toner image onto a recording material in contact with the image bearing member;

a vibration imparting portion for imparting vibration at a variable frequency to the recording material having passed through the transfer portion; and a control portion for controlling the frequency by the vibration imparting portion so that the frequency is decreased with an increasing length of the recording material having passed through the transfer portion during a process of passing the recording material through the transfer portion.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
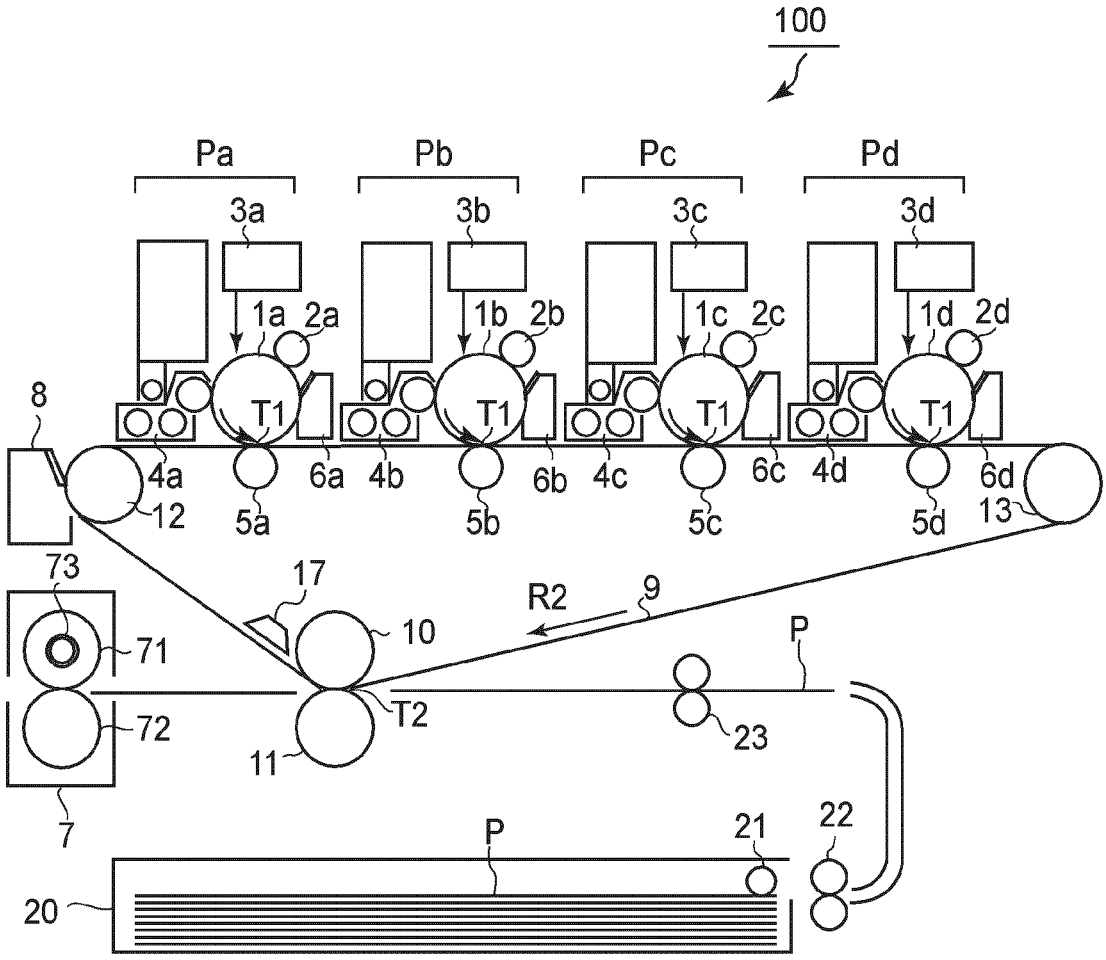
FIG. 1 is a schematic view for illustrating a structure of an image forming apparatus of First Embodiment.

Hereinbelow, several embodiments of the present invention will be described in detail with reference to the drawings. The present invention can be carried out also in other embodiments in which a part or all of constitutions of the respective embodiments are replaced by their alternative constitutions so long as a vibration impartment frequency with respect to a recording material is changed during passing of the recording material through a transfer portion or a separating portion.

Therefore, the present invention can be carried out at not only a secondary transfer portion at which a toner image is transferred from an intermediary transfer belt onto the recording material but also a transfer portion at which the toner image is transferred from a photosensitive drum onto the recording material.

In the following embodiments, only a principal portion concerning formation/transfer of the toner image will be described but the present invention can be carried out in various uses including printers, various printing machines, copying machines, facsimile machines, multi-function machines, and so on by adding necessary equipment, options, or casing structures.

Incidentally, general matters of the image forming apparatus and an ultrasonic wave generating device described in JP-A 2005-338423 and JP-A 2007-140413 will be omitted from the following description, thus being omitted from redundant explanation.

In the following description, respective means and portions represented by reference numerals or symbols are illustrative only and are not intended to limit the scope of the present invention.

First Embodiment

Figure 2:
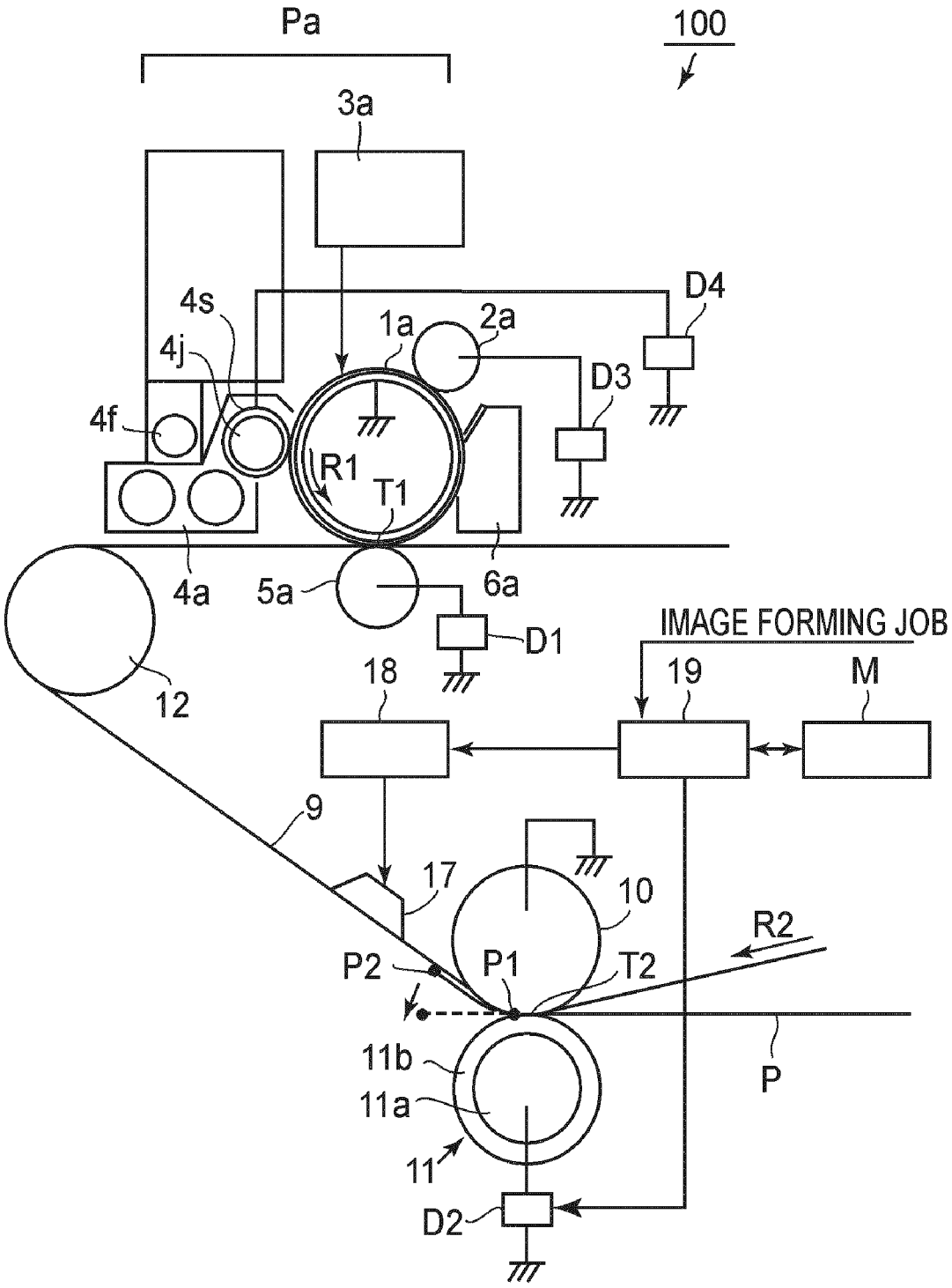
FIG. 2 is a schematic view for illustrating structures of an image forming station and a secondary transfer portion.

FIG. 1 is a schematic view for illustrating a structure of an image forming apparatus of First Embodiment and FIG. 2 is a schematic view for illustrating structures of an image forming station and a secondary transfer portion.

As shown in FIG. 1, an image forming apparatus 100 of First Embodiment is a tandem-type full-color copying machine of an intermediary transfer type in which four image forming stations Pa, Pb, Pc and Pd are arranged in a linear section of an intermediary transfer belt 9.

In the image forming station Pa, a yellow toner image is formed on a photosensitive drum 1*a* and then is primary-transferred onto the intermediary transfer belt 9. In the image forming station Pb, a magenta toner image is formed on a photosensitive drum 1*b* and is primary-transferred onto the yellow toner image on the intermediary transfer belt 9 in a superposition manner. In the image forming stations Pc and Pd, a cyan toner image and a black toner image are formed on photosensitive drums 1*c* and 1*d*, respectively, and are successively primary-transferred onto the magenta toner image on the intermediary transfer belt 9 in the superposition manner similarly as in the case of the image forming station Pb.

The four color toner images primary-transferred on the intermediary transfer belt 9 are conveyed to a secondary transfer portion T2, at which the toner images are collectively secondary-transferred onto a recording material P which has been fed to the secondary transfer portion T2. The four color toner images secondary-transferred on the surface of the recording material P at the secondary transfer portion T2 are fixed by a fixing device 7 under application of heat and pressure. Thereafter, the recording material P is discharged to the outside of the image forming apparatus 100.

The intermediary transfer belt 9 is supported by a tension roller 12, a driving roller 13, and a back-up roller 10 and is rotated in a direction of an arrow R2 at a process speed of 100 mm/sec. To the intermediary transfer belt 9, a stretching force of 30 N (3 kgf) is applied by the tension roller 12 and the intermediary transfer belt 9 is driven by transmitting a driving force from an unshown driving motor to an end portion of the driving roller 13.

A sheet-feeding roller 22 separates the recording material P, one by one, picked up by a pick-up roller 21 from a sheet-feeding cassette 20 to feed the separated sheet to registration rollers 23.

The registration rollers 23 as a sheet-feeding means receives the recording material P in a rest state to place the recording material P in a stand-by state and feeds the recording material P to the secondary transfer portion T2 while timing the recording material P to the toner image on the intermediary transfer belt 9.

A cleaning device 8 removes transfer residual toner which has passed through the secondary transfer portion T2 and remains on the intermediary transfer belt 9 by rubbing the intermediary transfer belt 9 with a cleaning blade.

The image forming stations Pa, Pb, Pc and Pd have the substantially same constitution except that the colors of toners of yellow for a developing device 4*a* provided in the image forming station Pa, magenta for a developing device 4*b* provided in the image forming station Pb, cyan for a developing device 4*c* provided in the image forming station Pc, and black for a developing device 4*d* provided in the image forming station Pd are different from each other. In the following description, the image forming station Pa will be described and with respect to other image forming stations Pb, Pc and Pd, the suffix a of reference numerals (symbols) for representing constituent members (means) is to be read as b, c and d, respectively, for explanation of associated ones of the constituent members.

As shown in FIG. 2, the image forming station Pa includes the photosensitive drum 1*a*. Around the photosensitive drum 1*a*, a charging device 2*a*, an exposure device 3*a*, the developing device 4*a*, a primary transfer roller 5*a*, and a cleaning device 6*a* are disposed in the image forming station Pa.

The photosensitive drum 1*a* is prepared by forming a photosensitive layer having a negative charge polarity on an outer peripheral surface of an aluminum-made cylinder. The photosensitive drum 1*a* is rotatably supported at both end portions thereof and is rotated in a direction of an arrow at a process speed of 100 mm/sec by transmitting a driving force from an unshown driving motor to one of the end portions.

The charging device 2*a* presses a charging roller against the photosensitive drum 1*a* so that the charging roller is rotated by the rotation of the photosensitive drum 1*a*. From a power source D3 to the charging roller, a superposed charging voltage consisting of a DC voltage and an AC voltage is applied, so that the surface of the photosensitive drum 1*a* is electrically charged uniformly to a negative-polarity potential.

The exposure device 3*a* writes (forms) an electrostatic image for an image on the charged surface of the photosensitive drum 1*d* by scanning of the charged surface through a rotating mirror with a laser beam obtained by ON/OFF modulation of scanning line image data expanded from a separated color image for yellow.

The developing device 4*a* stirs two component developer so as to be electrically charged negatively and be carried on a surface of a developing sleeve 4*s* with a chain thereof created by a magnetic force of a fixed magnetic pole 4*j*, thus rubbing against the photosensitive drum 1*a*. The developing sleeve 4*s* rotates around the fixed magnetic pole 4*j* in a direction opposite from the rotational direction of the photosensitive drum 1*a* at their contact position.

A power source D4 applies to the developing sleeve 4*s* a developing voltage in the form of a negative-polarity DC voltage biased (superposed) with an AC voltage, so that the negatively charged toner is deposited on the electrostatic image, on the photosensitive drum 1*a*, having a positive polarity relative to that of developing sleeve 4*s*. As a result, the electrostatic image is reversely developed.

The primary transfer roller 5*a* is urged by unshown spring members at both end portions thereof to sandwich the intermediary transfer belt 9 between the primary transfer roller 5*a* and the photosensitive drum 1*a*, thus forming a primary transfer portion T1 between the photosensitive drum 1*a* and the intermediary transfer belt 9.

A power source D1 applies a positive DC voltage to a roller shaft of the primary transfer roller 5*a*, so that the toner image negatively charged and carried on the photosensitive drum 1*a* is primary-transferred onto the intermediary transfer belt 9 passing through the primary transfer portion T1.

The cleaning device 6*a* rubs the photosensitive drum 1*a* with a cleaning blade to remove transfer residual toner which passed through the primary transfer portion T1 and remains on the surface of the photosensitive drum 1*a*.

<Transfer Portion>

The intermediary transfer belt 9 as an example of the image bearing member is formed in an endless belt shape having a width of 370 mm and a circumferential length of 900 mm and carries the toner image, which has been primary-transferred at the primary transfer portion T1, to the secondary transfer portion T2. The intermediary transfer belt 9 is formed of a resin material such as polyimide, polycarbonate, polyester, polypropylene, polyethylene telephthalate, acrylic resin, or vinyl chloride resin, or various rubber materials, etc.

In this embodiment, the intermediary transfer belt 9 is formed in a thickness of 0.07-0.5 mm and is adjusted to have a volume resistivity ρ of $10^9$ ohm.cm.

The back-up roller 10 is formed of a stainless steel-made cylindrical material having an outer diameter of 30 mm and is connected to ground potential.

The secondary transfer roller 11 as an example of a transfer member presses the intermediary transfer belt 9 against the back-up roller 10 to provide the secondary transfer portion T2 between the intermediary transfer belt 9 and the secondary transfer roller 11.

The secondary transfer roller 11 is finished to have an outer diameter of 26 mm by forming an elastic layer 11*b*, consisting of an ion-conductive elastic rubber layer such as urethane rubber and a coating layer, on an outer peripheral surface of a stainless steel-mode roller shaft 11*a*. The elastic rubber layer is formed of a foamed synthetic rubber material having a cell diameter of 0.05-1.0 mm and containing carbon black in a dispersion state, and the surface (coating) layer is formed in a thickness of 0.1-1.0 mm of a fluorine-containing material in which an ion-conductive polymer is dispersed. The secondary transfer roller 11 has an ASKER-C hardness of 35 degrees.

A power source D2 as an example of a power source means applies a positive-polarity constant voltage as a toner voltage to the roller shaft 11*a* of the secondary transfer roller 11, thus carrying a transfer current to a series circuit constituted by the back-up roller 10, the intermediary transfer belt 9, the recording material P, and the secondary transfer roller 11. As a result, the toner image is electrostatically moved from the intermediary transfer belt 9 to the recording material P during passing of the recording material P through the secondary transfer portion T2 while the toner image on the intermediary transfer belt 9 is superposed on the recording material P.

<Vibration Imparting Means and Control Means>

An ultrasonic vibration element 17 imparts vibration to the intermediary transfer belt 9, and a driving portion 18 drives the ultrasonic vibration element 17 by outputting a high-frequency voltage to the ultrasonic vibration element 17. The ultrasonic vibration element 17 and the driving portion 18 constitute a vibration imparting means. A control portion 19 is a micro-computer control device for centralizedly controlling the image forming apparatus 100 and executes image formation by using a control program and various data stored and retained in a memory M. The control portion 19 and the memory M co-operate to constitute a control means.

The ultrasonic vibration element 17 is disposed at both end portions and a central portion, i.e., three portions in total, of the intermediary transfer belt 9 so as to directly contact an inner surface of the intermediary transfer belt 9. In consideration of a margin of flexure of the intermediary transfer belt 9, the ultrasonic vibration element 17 press-contacts the intermediary transfer belt 9 at an appropriate pressure for transmitting vibration to the intermediary transfer belt 9.

A position of the press-contact of the ultrasonic vibration element 17 is not the secondary transfer portion T2 of the intermediary transfer belt 9 but is located downstream of the secondary transfer portion T2 with respect to a rotational direction of the intermediary transfer belt 9.

An amplitude of the vibration is separated by the secondary transfer roller 11 into an upstream side and the downstream side with respect to the secondary transfer portion T2, so that it is possible to effectively impart the vibration to the leading end of the recording material P when the ultrasonic vibration element 17 is disposed on the downstream side rather than the upstream side of the secondary transfer portion T2. As a result, it is possible to enhance a separating property of the recording material P on the downstream side of the secondary transfer portion T2.

The ultrasonic vibration element 17 uses a ferrite vibration element, a piezoelectric element, or the like which is capable of vibrating at a frequency in an ultrasonic range and vibrates in accordance with a driving voltage and a frequency of a high-frequency voltage outputted from the driving portion 18.

The driving portion 18 is a driving power source for outputting a high-frequency driving voltage to the ultrasonic vibration element 17 and is controlled by the control portion 19 to change a frequency of the driving voltage, thus outputting the driving voltage with a set amplitude.

For example, a sine wave output voltage V(t) having a voltage amplitude V0 corresponding to a power of approximately 20-600 W and a frequency f of 5000 kHz at the maximum is outputted.

$$V(t)=V0 \sin(2\pi ft)$$

At this time, the ultrasonic vibration element 17 causes a timewise displacement (change), i.e., sine wave vibration×(t) represented by the following equation:

$$X(t)=X0 \sin(2\pi ft),$$

wherein X0 represents an amplitude of the sine wave vibration×(t) and is approximately 35-40 μm at the maximum. This sine wave vibration×(t) is transmitted to the secondary transfer portion T2 through the intermediary transfer belt 9 to cause minute vibration with respect to the recording material P.

The control portion 19 controls a frequency and an amplitude of vibration to be imparted through the driving portion 18 to the recording material P by the ultrasonic vibration element 17.

The control portion 19 timely reads necessary information, such as a vibration frequency and a vibration amplitude of the driving voltage to be set with respect to the driving portion 18, from the memory M at necessary time.

The driving portion 19 sets the vibration frequency of the ultrasonic vibration element 17 depending on a sequence of separation of the recording material P and starts the vibration at an appropriate time for separation timing and then changes the vibration frequency at an appropriate time for frequency changing timing.

The vibration generated from the ultrasonic vibration element 17 provides a compressional wave which is a longitudinal wave such as an ultrasonic wave or the like. The ultrasonic vibration imparts vibration to the leading end portion of the recording material P stuck to the intermediary transfer belt 9, so that cantilever vibration is generated with a rear end P1 of the secondary transfer portion T2 as a node.

<Behavior of Recording Material by Vibration Impartment>

Figure 3:
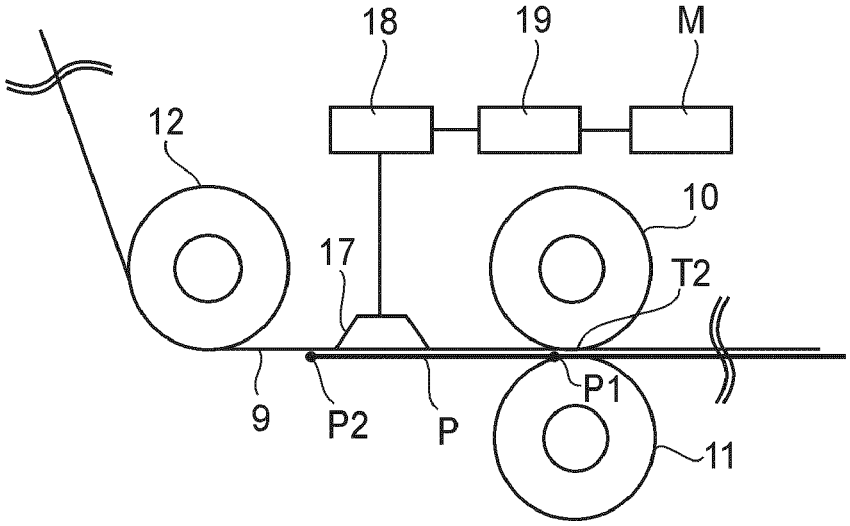
FIGS. 3(*a*) and 3(*b*) are schematic views for illustrating vibration of a recording material at a secondary transfer portion.
Figure 3:
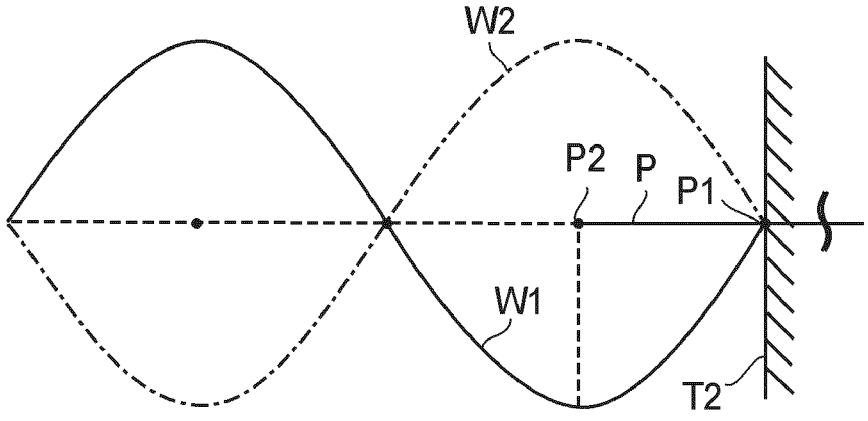
Figure 4:
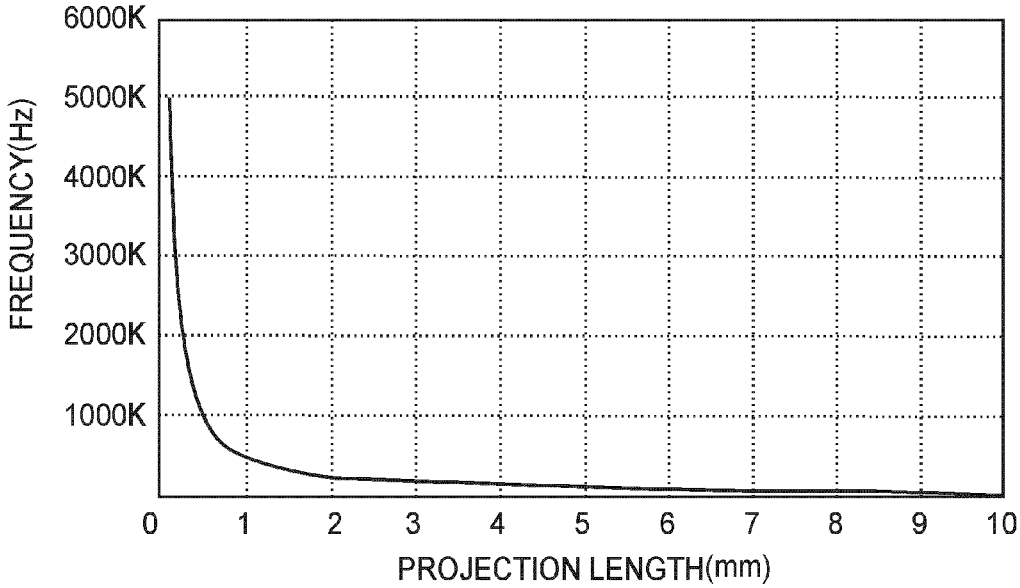
FIG. 4 is a graph showing a relationship between a projection length and an optimum vibration impartment frequency.

FIGS. 3(*a*) and 3(*b*) are schematic views for illustrating the vibration of the recording material at the secondary transfer portion, wherein FIG. 3(*a*) is a schematic view at the secondary transfer portion and FIG. 3(*b*) is a schematic view for illustrating the cantilever vibration of the recording material. FIG. 4 is a graph showing a relationship between a projection length and an optimum vibration impartment frequency.

As shown in FIG. 3(*a*), a certain moment at which a leading end P2 of the recording material P has passed through the rear end P1 of the secondary transfer portion T2 but the recording material P has not completely passed through the secondary transfer portion T2 will be considered.

The ultrasonic vibration element 17 shakes the recording material P stuck to the intermediary transfer belt 9 off the intermediary transfer belt 9 by imparting vibration to the intermediary transfer belt 9 in a fixed length between the back-up roller 10 and the tension roller 12. By utilizing a difference in natural vibration frequency between the intermediary transfer belt 9 in the fixed length and the recording material P changed in projection length every moment, a large different in amplitude is created between the intermediary transfer belt 9 and the recording material P to separate the recording material P from the intermediary transfer belt 9.

The ultrasonic vibration element 17 imparts vibration to the leading end area of the recording material P projected from the secondary transfer portion T2 with a resonance frequency. Then, the vibration impartment frequency is lowered so as to follow a lowering in primary resonance frequency in the leading end area increased in length at a rate of 100 mm/sec by the conveyance of the recording material P. As a result, the large difference in amplitude between the intermediary transfer belt 9 and the recording material P is retained, so that a high separation performance and a re-sticking (attachment) preventing effect are achieved.

FIG. 3(*b*) shows a cantilever model, correspondingly to FIG. 3(*a*), in which the rear end P1 of the secondary transfer portion T2 is a fixed end and the leading end P2 is a free end. By applying mechanical vibration to the recording material P constituting the cantilever, standing waves W1 and W2 are generated in the recording material P. These standing waves W1 and W2 provide a phase difference of n. When the standing wave W1 is taken as an initial phase, the standing wave W1 is the standing wave W2 with half period and is returned to the standing wave W1 with one period.

Here, a frequency of mechanical vibration capable of maximizing an amplitude of the standing wave generated in the recording material P with the highest degree of efficiency is determined by a passing length of the recording material P from the secondary transfer portion T2, i.e., a projection length from the leading end of the recording material P to the rear end P1 of the secondary transfer portion T2.

Of the above-described vibration impartment frequencies, the lowest order frequency (primary frequency) can be obtained by a formula shown below when the projection length from the rear end P1 of the secondary transfer portion T2 to the leading end P2 of the recording material P is taken as l and a transmission speed of a sound wave in the recording material P is taken as v.

$$f=v/4l$$

The transmission speed v varies depending on elasticity modulus, density, and the like of the recording material P.

Incidentally, in the present invention, a separation property of thin paper is a problem to be solved, so that an influence with respect to a thickness direction in the above parameters is ignored.

The projection length l is increased with elapsed time after the leading end P2 of the recording material P has passed through the rear end P1 of the secondary transfer portion T2, so that it is necessary to lower the vibration impartment frequency in order to retain the amplitude of the standing wave of the recording material P at the maximum level.

As shown in FIG. 4 with reference to FIGS. 3(*a*) and 3(*b*), when the leading end P2 of the recording material P comes out of the secondary transfer portion T2, a vibration frequency to be imparted depending on the projection length l varying every moment is also changed every moment. In this embodiment, the recording material P is a resin material film (PET sheet) and the sound wave transmission speed in the recording material P is 2000 m/sec. Further, a process speed is 100 mm/sec and the vibration impartment is carried out in a section of 10 mm from the leading end P2 correspondingly to a length of a leading end margin of the recording material P.

As shown in FIG. 4, by changing the vibration impartment frequency while keeping the relationship: f=v/4l capable of exciting the lowest order natural mode of vibration, the vibration impartment to the leading end P2 of the recording material P is continued with the maximum amplitude, thus enhancing the separation property.

The control portion 19 obtained positional information of the leading end P2 of the recording material P by positioning of the recording material P with respect to the toner image carried on the intermediary transfer belt 9. Then, the control portion 19 continuously changes an output frequency of the ultrasonic vibration element 17 depending on an elapsed time from a predicted time at which the leading end P2 passes through the secondary transfer portion T2.

The frequency is applied depending on the projection length l varying every moment obtained from the following formula:

$$l=0.1t(m)$$

Figure 5:
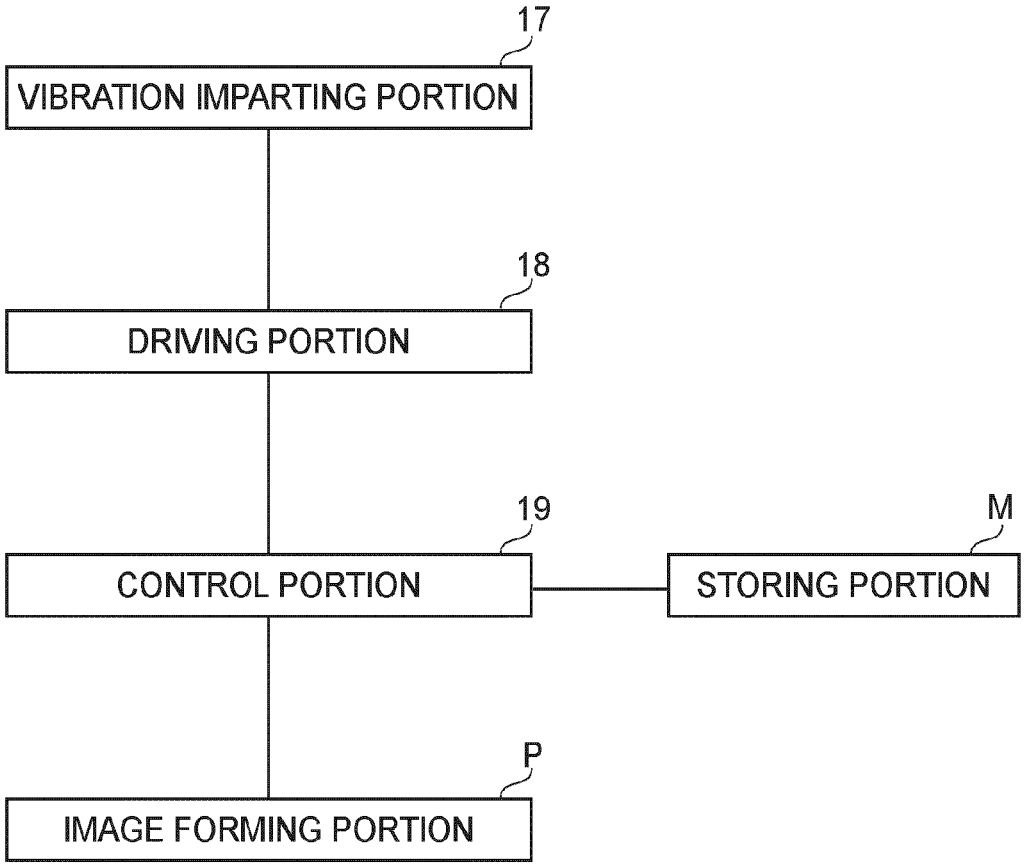
FIG. 5 is a block diagram of First Embodiment.

FIG. 5 shows a block diagram of this embodiment. In this embodiment, the control portion 19 is connected to the storing portion (memory) M. Further, the control portion 19 connected to the storing portion M sends a signal to the driving portion 18. The driving portion 18 actuates the vibration imparting portion 17 depending on the signal. Further, the control portion 19 functions as a portion for controlling the image forming portion (station) P.

<Vibration Impartment Control>

Figure 7:
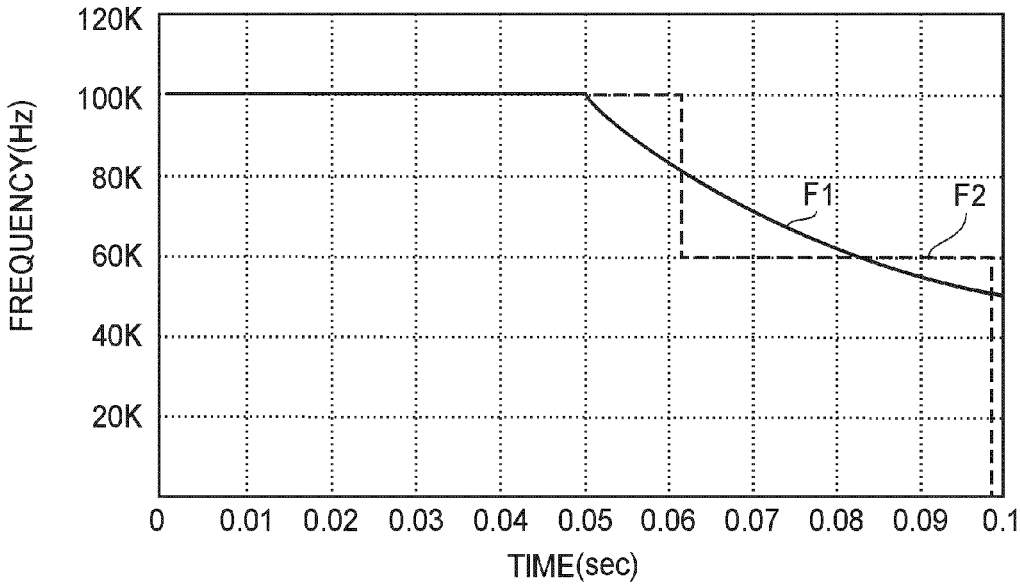
FIG. 7 is a graph showing a change in vibration impartment frequency by vibration impartment control.
Figure 6:
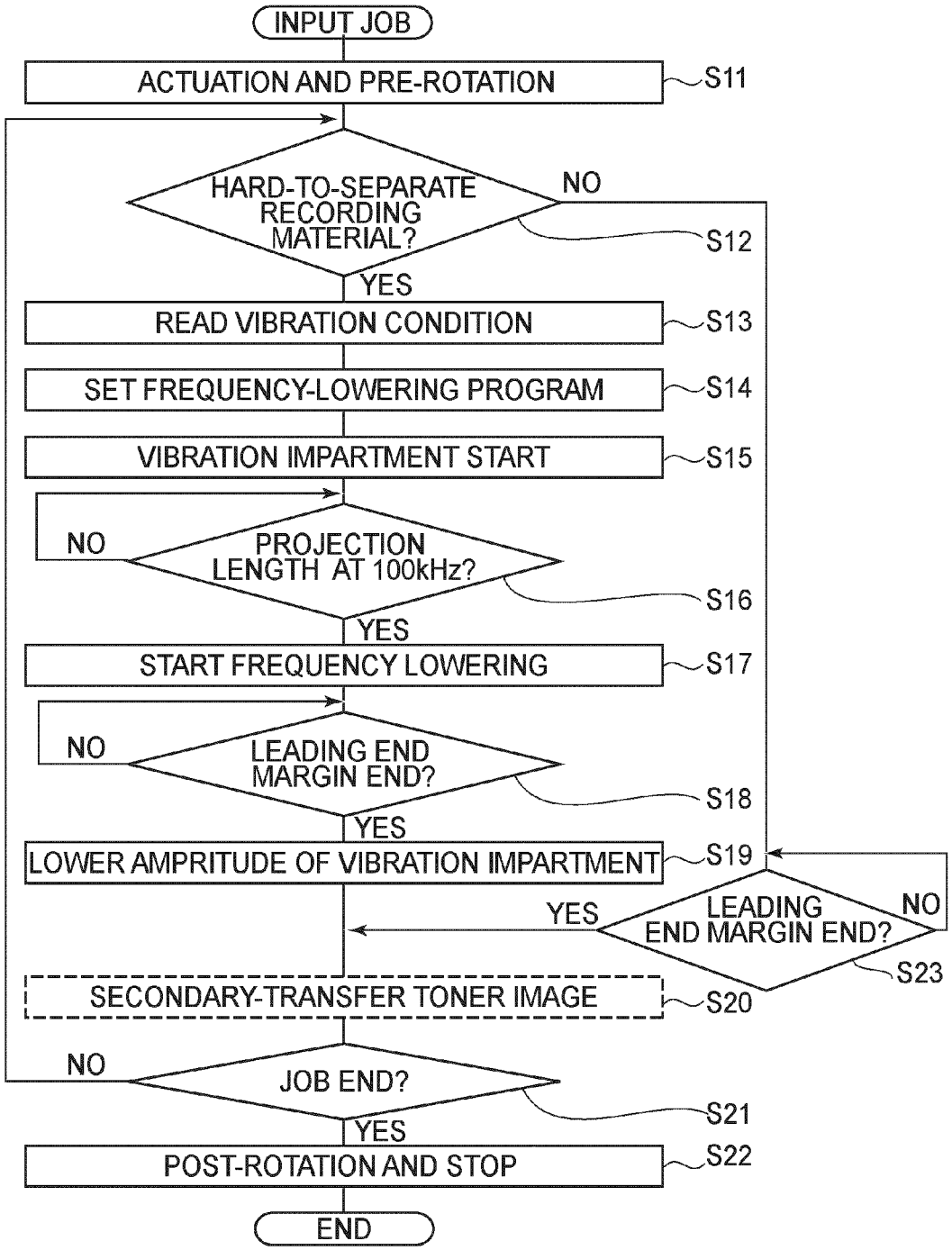
FIG. 6 is a flow chart for illustrating an operation of a vibration imparting process.

FIG. 6 is a flow chart showing an operation of a vibration impartment process and FIG. 7 is a graph for illustrating a change in vibration impartment frequency by vibration impartment control.

As shown in FIG. 6 with reference to FIG. 2, the control portion 19 executes control for imparting vibration to the recording material P on the downstream side of the secondary transfer portion T2 in parallel with a process for forming the toner image on the photosensitive drum 1. In FIG. 6, only the vibration impartment control of the recording material P is shown.

When an image forming job is inputted, the control portion 19 actuates the image forming apparatus 100 and executes pre-rotation to set operation conditions of respective portions (S11).

The control portion 19 judges whether or not a recording material P designated by the job data corresponds to a preliminarily registered hard-to-separate recording material P (S12).

The control portion 19 does not execute the vibration impartment control of the recording material P when the recording material P does not correspond to the hard-to-separate recording material P, and secondary-transfers the toner image at the secondary transfer portion T2 (S23 and S20).

The control portion 19 reads a vibration condition preliminarily stored in the memory M when the recording material P corresponds to the hard-to-separate recording material P (S13). The vibration condition is a condition for providing instructions to the driving portion 18 so as to vibrate the ultrasonic vibration element 17 and includes a driving voltage V as an amplitude of the vibration and a changing condition of a vibration frequency f calculated from an image forming speed or the like. A specific state of the change in frequency is shown by a curve F1 indicated in FIG. 7.

The control portion 19 sets a frequency lowering program which is called up depending on the type of the recording material P and the process speed (S14). The frequency lowering problem includes a range in which the vibration impartment frequency is changed in advance in view of the image forming speed and a changing method and is stored in the memory M.

The control portion 19 starts the vibration impartment by the ultrasonic vibration element 17 at a constant frequency of 100 kHz determined as an upper limit of a normal frequency range of the ultrasonic vibration element 17 (S15). This is because, in a range exceeding 100 Hz shown in FIG. 7, heat generation of the ultrasonic vibration element 17 is extraordinary and thus the recording material P cannot be vibrated efficiently.

The control portion 19 provides instructions to the driving portion 18 with respect to initial values of the driving frequency f and the driving voltage V and the driving portion 18 vibrates the ultrasonic vibration element 17 according to the instructions.

The control portion 19 starts the lowering in frequency as shown in FIG. 7 with timing at which the passing (projection) length of the recording material P reaches a predetermined length depending on the recording material P (S16 and S17). That is, the timing is such that the projection length l of the recording material P from the secondary transfer portion T2 reaches the predetermined length in which the natural vibration frequency is 100 kHz. In this embodiment, the passing length of the recording material P is obtained from a preset conveying speed of the recording material P and a time counted from the start of passing of the recording material P through the secondary transfer portion T2 by the control portion 19.

Thereafter, the control portion 19 performs a vibration control operation for imparting vibration while changing the driving frequency according to the condition, thus successively changing the driving frequency f with elapsed time. In this case, an output V of the driving voltage $V\sin(2\pi f)$ corresponding to the driving frequency f is preset at a certain value corresponding to a power of approximately 20-600 W by reading the value from the memory M.

The control portion 19 lowers the amplitude of the vibration impartment after the passing length reaches a toner image carrying area of the recording material P. When the leading end margin of the recording material P reaches the rear end of the secondary transfer portion T2 (YES of S18), the output V is lowered and thus the amplitude of the vibration impartment is lowered (S19).

This is because the toner is scattered when the recording material P carrying thereon the toner image is continuously vibrated with a large amplitude. This is also because when the leading end of the recording material P is separated with reliability, a subsequent portion can be separated relatively easily by a weight of the separated leading end portion.

After the secondary transfer is completed (S20), the process of S12 to S21 is repeated (NO of S21) until the job is completed (YES of S21) and then the image forming apparatus 100 is subjected to post-rotation control to be stopped (S22).

As shown in FIG. 7 with reference to FIG. 2, the frequency of the vibration to be imparted with elapsed time after the leading end P2 of the recording material P comes out of the secondary transfer portion T2.

The frequency to be applies is kept constant for a predetermined time and thereafter is lowered.

Also in this case, the recording material P is a resin material film (50 μm-thick PET film) and the second wave transmission speed in the material is 2000 m/sec. Further, the process speed is 100 mm/sec and the leading end margin is up to 10 mm. Further, the problem to be solved is separate of the thin paper at the transfer portion and thus the influence with respect to the thickness direction is ignored. Further, the predetermined time is 0.05 sec and a corresponding projection length l of the recording material P is 5 mm.

Generally, an applicable frequency is limited by a shape, a performance, and the like of the ultrasonic vibration element 17, so that in the case where the projection length of the recording material P is extremely short, a large effect cannot be expected even when a corresponding frequency is applied. For this reason, the frequency to be applied is kept at a constant frequency until the projection length l of the recording material P reaches a predetermined length and thereafter is lowered with elapsed time so that the amplitude at the leading end P2 of the recording material P is maximum to keep the relationship of $f=v/4l$. In First Embodiment, the vibration frequency to be applied is set to satisfy the relationship of $f=v/4l$ but may preferably be adjusted in consideration of a fluctuation of the natural vibration mode of the recording material P including influences of the respective members such as the intermediary transfer belt 9 and the secondary transfer portion T2 which are actually used.

It is desirable that the frequency lowering program and the lowering start timing are adjusted depending on variations of an output characteristic of the ultrasonic vibration element 17 and an output frequency of the driving portion 18 in addition to the influences of the above-described members.

As a result, it is possible to solve such a problem that unavoidable variations occur due to various factors even when the natural vibration mode is controlled by the frequency to be applied and therefore a sufficient vibration force cannot be obtained and thus the separation performance cannot be sufficiently enhanced. Further, it is possible to achieve improvement and maintenance of the separation property (performance) by controlling the vibration frequency so as to provide a sufficient amplitude.

First Embodiment is not limited to the above-described constitution and control but can also be variously modified within the scope of the present invention.

Second Embodiment

Figure 8:
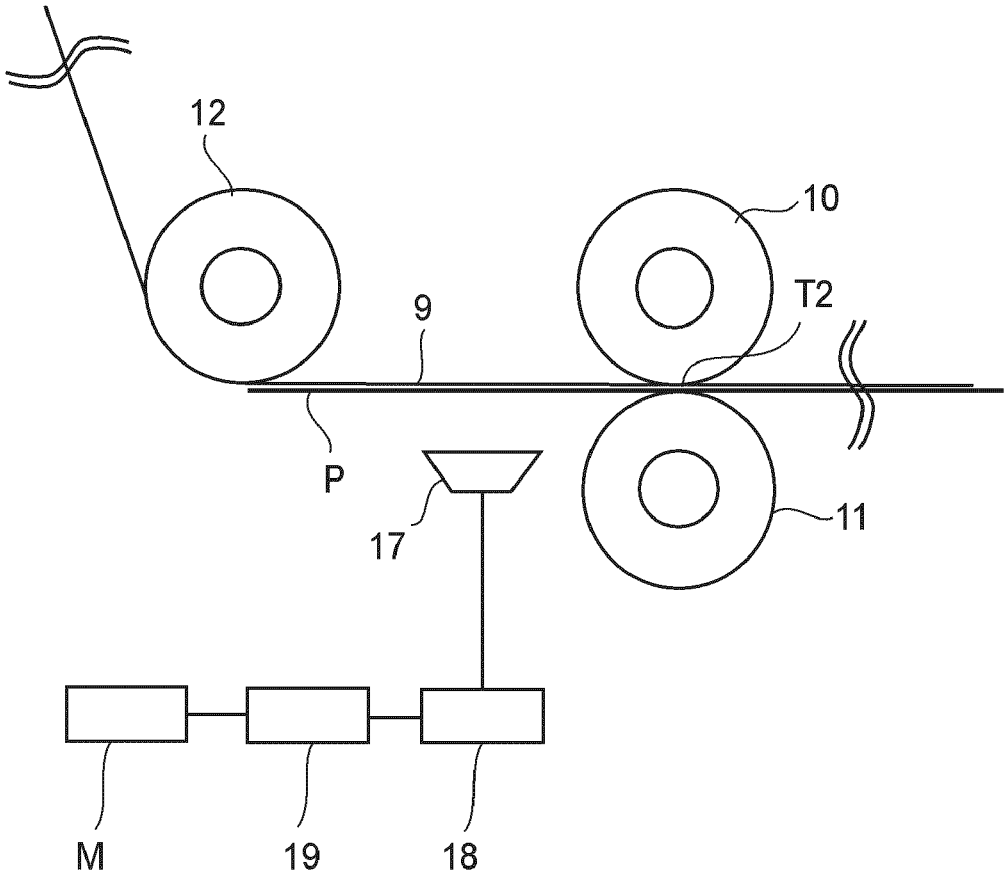
FIG. 8 is a schematic view for illustrating arrangement of an ultrasonic vibration element in Second Embodiment.

FIG. 8 is a schematic view for illustrating arrangement of the ultrasonic vibration element in Second Embodiment.

In Second Embodiment, only the arrangement of the ultrasonic vibration element is different from that in the image forming apparatus 100 of First Embodiment described with reference to FIGS. 1 to 7, and other constitutions are similar to those in First Embodiment. Therefore, in FIG. 8, the constitutions common to First Embodiment are represented by reference numerals or symbols common to FIG. 3(*a*), thus being omitted from redundant explanation.

As shown in FIG. 8, in Second Embodiment, the ultrasonic vibration element 17 is disposed apart from the outer surface of the intermediary transfer belt 9 with a shape therebetween and the recording material P passes through the space.

The ultrasonic vibration element 17 in this embodiment is an element for imparting ultrasonic vibration to the recording material P via air and the driving portion 18 outputs a high-frequency voltage to the ultrasonic vibration element 17 to drive the ultrasonic vibration element 17. The ultrasonic vibration element 17 and the driving portion 18 constitute a vibration device as a vibration imparting means. The control portion 19 is a micro-computer provided with a CPU and is operated by a control program written in the memory M such as an RAM. The control portion 19 and the memory M co-operate and function as a control means.

The ultrasonic vibration element 17 is disposed opposite to a back surface of the recording material onto which the toner image is not secondary-transferred. In view of a thickness of the recording material P and an amplitude of the vibration imparted recording material P, the ultrasonic vibration element 17 is disposed with a spacing of 50 μm at the minimum from the intermediary transfer belt 9.

The ultrasonic vibration element 17 is provided at three portions, corresponding to both end portions and a central portion of the intermediary transfer belt 9, through an elongated vibrating member (not shown) with respect to a widthwise direction of the intermediary transfer belt 9. In this embodiment, instead of the intermediary transfer belt 9 for imparting the vibration to the recording material P with respect to the entire width of the recording material P in First Embodiment, the vibrating member is provided, so that the entire width of the recording material P is subjected to uniform vibration impartment even with respect to various size recording materials P.

Third Embodiment

Figure 9:
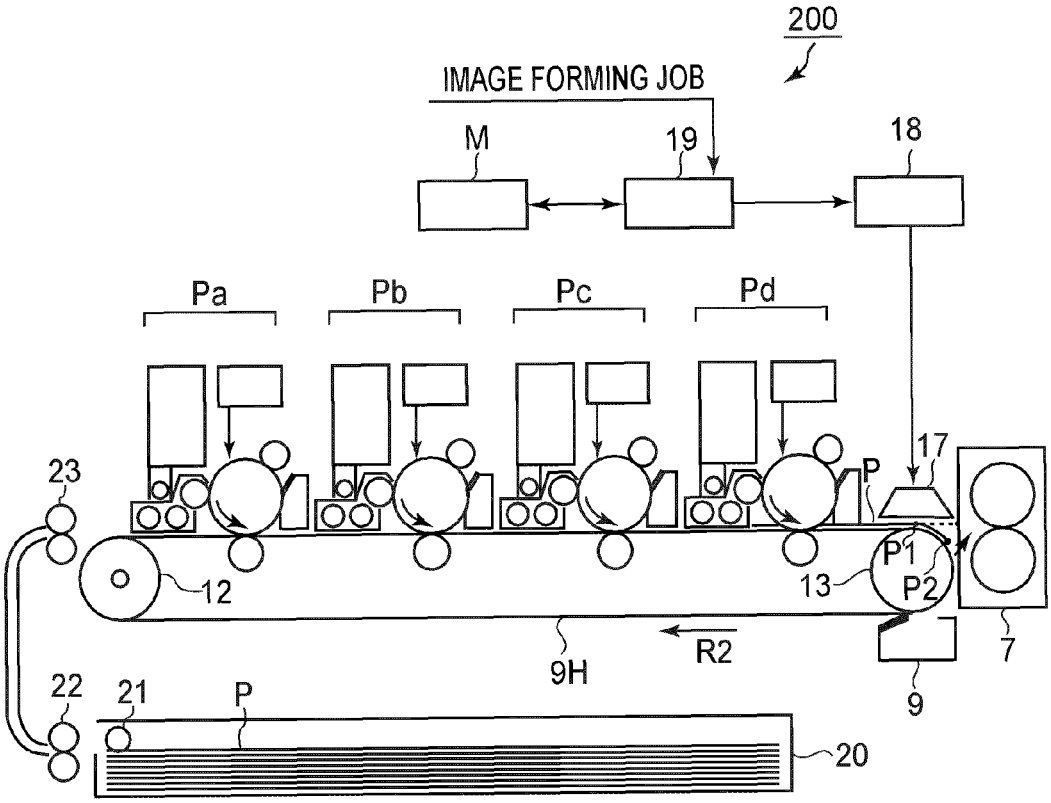
FIG. 9 is a schematic view for illustrating a structure of a separating portion in Third Embodiment.

FIG. 9 is a schematic view for illustrating a structure of a separating portion of an image forming apparatus of Third Embodiment.

An image forming apparatus 200 of this embodiment is a tandem-type direct transfer full-color image forming apparatus in which image forming stations Pa, Pb, Pc and Pd for yellow, magenta, cyan, and black are disposed in a linear section of a recording material conveyer belt 9H. In FIG. 9, constituent members common to Embodiment 1 are represented by reference numerals or symbols common to FIGS. 1 and 2, thus being omitted from redundant explanation.

The image forming apparatus 200 includes the ultrasonic vibration element 17 disposed at a recording material separating portion of the recording material conveyer belt 9H.

The recording material conveyer belt 9H is formed of the same material as that of the intermediary transfer belt (9: FIG. 1) in First Embodiment and electrostatically adsorbs the recording material P during passing thereof through the first image forming station Pa while carrying the recording material P. As a result, the recording material P and the recording material conveyer belt 9H are easily separated at the image forming stations Pa, Pb, Pc and Pd but curvature separation of the recording material P by the driving roller 13 (supporting member) is problematic.

Therefore, in this embodiment, similarly as in Second Embodiment, the ultrasonic vibration element 17 is disposed apart from the recording material P, so that ultrasonic vibration is imparted to the recording material P via air. The control portion 19 lowers a frequency of a driving signal outputted from the driving portion 18 with elapsed time after the leading end of the recording material P has passed through a normal separating point P1 similarly as in Second Embodiment.

As a result, the ultrasonic vibration element 17 continuously imparts vibration, at a natural vibration frequency, to a portion of the recording material P from the normal separating point P1 to a leading end P2 contacting the recording material conveyer belt 9H.

Modified Embodiments

In recent years, with increasing use of an electrophotographic image forming apparatus, the image forming apparatus is required to meet various recording materials. Further, there is an increasing possibility that when thin paper or an easy-to-charge resin material film is used as the recording material, the recording material is electrostatically stuck to the intermediary transfer belt, the photosensitive drum, or the recording material conveyer belt to cause separation failure such that the recording material P cannot be satisfactorily separated by curvature separation. This separation failure is principally attributable to insufficient rigidity (poor fragileness) of the recording material in the case of a small basis weight and excessive electrostatic force.

When a total amount of electric charges given from the back surface of the recording material exceeds a total amount of toner electric charges at the transfer portion, the electrostatic force acting on the recording material is directed toward the image bearing member side, so that the recording material is deformed by this electrostatic force to be stuck to the image bearing member in some cases. Further, in the case of a small basis weight of the recording material, rigidity of the recording material is low, so that there is an increasing possibility that power of the curvature separation becomes insufficient and therefore the recording material is stuck to the image bearing member.

In First to Third Embodiments, with respect to such problems, the ultrasonic vibration element 17 is used to ensure the separating property. The recording material P is continuously subjected to the vibration impartment at a frequency close to the natural frequency by changing the frequency of the ultrasonic wave outputted from the ultrasonic vibration element 17, so that the separating effect is ensured efficiently more than the case of continuously applying a constant frequency, i.e., at a level equal to or more than that in the case of continuously applying the constant frequency with lower power supply.

The leading end length of the recording material is changed with the lapse of time, so that it is possible to keep the standing wave vibration mode of the natural vibration frequency at the leading end of the recording material at a high amplitude level by changing the frequency of the vibration to be imparted to the recording material leading end. Therefore, it is possible to always retain the vibration mode of the recording material leading end in a state convenient to separation, so that improvement and maintenance of the separation property can be achieved by stable separate assistance.

As described in First Embodiment, the ultrasonic vibration element 17 may also be disposed in contact with the inner surface of the intermediary transfer belt 9.

As described in Second Embodiment, the ultrasonic vibration element 17 may also be disposed opposite to the back surface of the recording material P. Further, the ultrasonic vibration element 17 may be disposed apart from the recording material and the intermediary transfer belt so long as the ultrasonic vibration is transmitted to the recording material P.

As described in Third Embodiment, the ultrasonic vibration element 17 may be disposed opposite to the separating area of the recording material P on the recording material conveyer belt 9H for carrying the recording material P.

The ultrasonic vibration element 17 may also be disposed by being incorporated in the driving roller 13 on the separation side of the recording material conveyer belt 9H in Third Embodiment or in the secondary transfer roller 11 as the transfer member in First Embodiment.

The ultrasonic vibration element 17 may be replaced with another vibration imparting element with a variable vibration frequency. Further, it is also possible to carry out control of changing the frequency in a similar manner by using an impact element such as a voice coil or the like, or using a motor, a vibrator, and the like.

The change in frequency is not necessarily continuous. As shown by a curve F2 indicated in FIG. 7, the change in frequency may also include at least one intermittent or non-continuous portion. This is because the separating property is enhanced by a degree corresponding to an increase in the number of occurrences of the vibration impartment at the frequency close to the natural frequency when compared with the case of continuously applying the constant frequency.

The control portion 19 controls the vibration imparting means 17 for imparting the vibration to the recording material P having passed through the transfer portion T2 with a variable frequency, so that the frequency is lowered at least one time when the passing length of the recording material P is increased during the passing of the recording material P through the transfer portion T2.

The control portion 19 controls the vibration imparting means 17 for imparting the vibration to the recording material P having passed through the separating portion P1 with a variable frequency, so that the frequency is lowered at least one time when the passing length of the recording material P is increased during the passing of the recording material P through the separating portion P1.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 298390/2007 filed Nov. 16, 2007, which is hereby incorporated by reference.

What is claimed is:

1. An image forming apparatus comprising:

an image bearing member for bearing a toner image;

a transfer member for forming a transfer portion for transferring the toner image onto a recording material in contact with said image bearing member;

a vibration imparting portion for imparting vibration at a variable frequency to the recording material having passed through the transfer portion; and a control portion for controlling the frequency by said vibration imparting portion so that the frequency is decreased with an increasing length of the recording material having passed through the transfer portion during a process of passing the recording material through the transfer portion.

2. An apparatus according to claim 1, wherein said image bearing member is an intermediary transfer belt for carrying the toner image and wherein said vibration imparting portion is located downstream of the transfer portion and imparts vibration to said intermediary transfer belt.

3. An apparatus according to claim 1, wherein said control portion changed the frequency to be decreased depending on a type of the recording material.

4. An apparatus according to claim 1, wherein said control portion continuously decreases the frequency after the length of the recording material having passed through the transfer portion reaches a predetermined length.

5. An apparatus according to claim 1, wherein said control portion decreases an amplitude of vibration impartment after the length of the recording material having passed through the transfer portion reaches a toner image carrying area of the recording material.

6. An apparatus according to claim 1, wherein said control portion does not actuate said vibration imparting portion with respect to an easy-to-separate recording material.

* * * * *